United States Patent [19]

Burkholder

[11] 4,360,181

[45] Nov. 23, 1982

[54] THREE-PIECE BRACKET ASSEMBLY

[75] Inventor: Harvey Z. Burkholder, Denver, Pa.

[73] Assignee: Favorite Manufacturing, Inc., New Holland, Pa.

[21] Appl. No.: 241,630

[22] Filed: Mar. 9, 1981

[51] Int. Cl.[3] ..... A47G 29/02

[52] U.S. Cl. ..... 248/248; 108/108

[58] Field of Search ..... 248/235, 241, 242, 243, 248/247, 248; 108/108; 211/90, 187, 190

[56] References Cited

U.S. PATENT DOCUMENTS

| | | | |
|---|---|---|---|
| 208,319 | 9/1878 | Jones | 248/235 |
| 498,027 | 5/1893 | Recht | 248/247 |
| 910,591 | 1/1909 | Shue | 248/235 |
| 1,005,375 | 10/1911 | Vanderveld | 248/243 |
| 1,008,720 | 11/1911 | Knape | 248/243 |
| 1,156,129 | 10/1915 | Berger | 211/90 UX |

FOREIGN PATENT DOCUMENTS

| | | | |
|---|---|---|---|
| 1287108 | 1/1962 | France | 211/187 |

*Primary Examiner*—J. Franklin Foss

*Attorney, Agent, or Firm*—Howson and Howson

[57] ABSTRACT

A bracket assembly which is capable of being erected without separate fasteners is disclosed. The bracket assembly comprises an upright, an arm having a hook at one end engaging the upright and having a specially-shaped notch in its underside, and a brace extending at an angle between the arm and the upright. One end of the brace has a tip which engages in the arm notch when the brace is pivoted upwardly. A tang on the other end of the brace extends through a hole in the upright to lock the assembly when bent against the upright.

7 Claims, 5 Drawing Figures

THREE-PIECE BRACKET ASSEMBLY

FIELD OF THE INVENTION

The present invention relates to support brackets, and more particularly, the present invention relates to brackets which find particular utility in supporting cage rows in a bank of poultry cages.

BACKGROUND OF THE INVENTION

In copending application Ser. No. 226,497, filed on Jan. 19, 1981, and owned by the assignee of the present application, there is disclosed a frame assembly on which rows of poultry cages are supported. The frame assembly has a pair of uprights connected adjacent their tops and bottoms by cross members, and a series of vertically-spaced cage-supporting arms extending inwardly from the uprights. Braces extend at an angle between the arms and the supporting uprights.

The frame assemblies are generally located at about ten foot intervals in a typical cage bank, which may be several hundred feet long. A typical poultry house may contain several such banks of cages. Thus, since a substantial number of frame assemblies are required, it should be apparent that a much greater number of braced arms are required. If the braced arms were assembled using conventional fasteners, such as nuts and bolts, a considerable amount of labor would be required to erect a cage bank, not to mention the additional cost of conventional fasteners.

OBJECTS OF THE INVENTION

With the foregoing in mind, a primary object of the present invention is to provide a novel three-piece bracket assembly which can be erected without requiring any separate fasteners.

Another object of the present invention is to provide an improved bracket assembly which is particularly suited for use in a poultry cage frame to enable poultry cage banks to be erected with a minimum of labor.

A further object of the present invention is to provide a sturdy bracket assembly which is capable of being erected readily even by unskilled labor using common hand tools.

SUMMARY OF THE INVENTION

More specifically, the present invention comprises a unique three-piece bracket assembly which is capable of being erected quickly without requiring separate fasteners. The bracket assembly comprises an upright having vertically-spaced holes, a lateral arm having a hook engaged in the upper one of the holes, and a brace connecting the arm to the upright. Cooperating latch means on one end of the brace and the arm locks the brace to the arm when the brace is pivoted upwardly. The other end of the brace has a tang which passes through the lower hole in the upright to lock the assembly when the tang is bent.

BRIEF DESCRIPTION OF THE DRAWINGS

The foregoing and other objects, features and advantages of the present invention should become apparent from the following description when taken in conjunction with the accompanying drawings, in which.

DESCRIPTION OF PREFERRED EMBODIMENT

Figure 1:
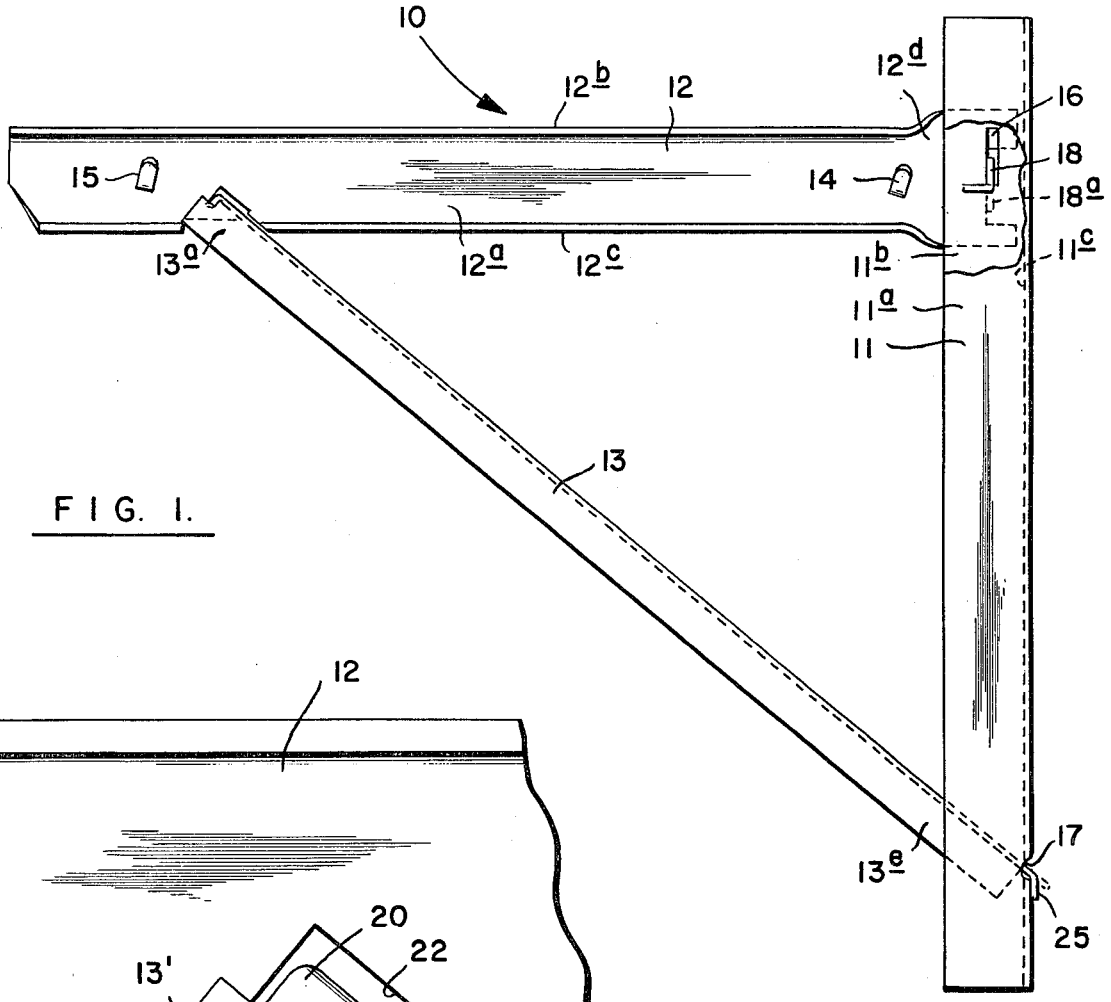
FIG. 1 is a side elevational view with a portion broken away of a bracket assembly embodying the present invention.

Referring now to the drawings, FIG. 1 illustrates a bracket assembly 10 which embodies the present invention. The bracket assembly 10 comprises an upright 11, an arm 12 extending laterally with respect to the upright 11 and a brace 13 connected at an angle between the arm 12 and upright 11. The bracket assembly 10 finds particular utility as a support for a poultry cage. When used in this manner, the top panel of the poultry cage rests on the top of the arm 12, and a pair of tabs 14 and 15 struck from the arm 12 engage horizontal wires in a side panel of the cage to provide additional support. While the present invention finds particular utility as a poultry cage support, it should be apparent that it may be utilized in any of a number of applications where a sturdy, easy to assemble support is required.

Referring again to FIG. 1, the upright 11 has a U-shaped transverse cross section providing a pair of parallel flanges or legs 11*a* and 11*b* connected together by an integral web 11*c*. A rectangular hole 16 is provided in the rear leg 11*b*, and a circular hole 17 is provided in the web 11*c*. The circular hole 17 is located below the rectangular hole 16.

The arm 12 has a generally planar web 12*a* with a pair of laterally turned narrow flanges 12*b* and 12*c* extending along the upper and lower edges of the web 12*a*. The inner end of the arm 12 is flared at 12*d* to engage flat against the outside of the upright leg 11*b*. This portion 12*d* of the arm 12 has a laterally turned hook 18 with a bendable terminus 18*a*. The hole 16 in the upright 11 is of sufficient size as to permit the hook 18 to pass laterally through the hole 16 and then downwardly into the position illustrated. Thereafter, the tip 18*a* is preferably bent by means of a narrow-nosed pliers into the position indicated in full lines in FIG. 1. Preferably, the hole 16 in the upright 11 is oversized with respect to the hook 18 to provide some clearance or play in the arm to upright connection for permitting the outermost end of the arm 12 to be raised slightly for purposes to be described.

Figure 2:
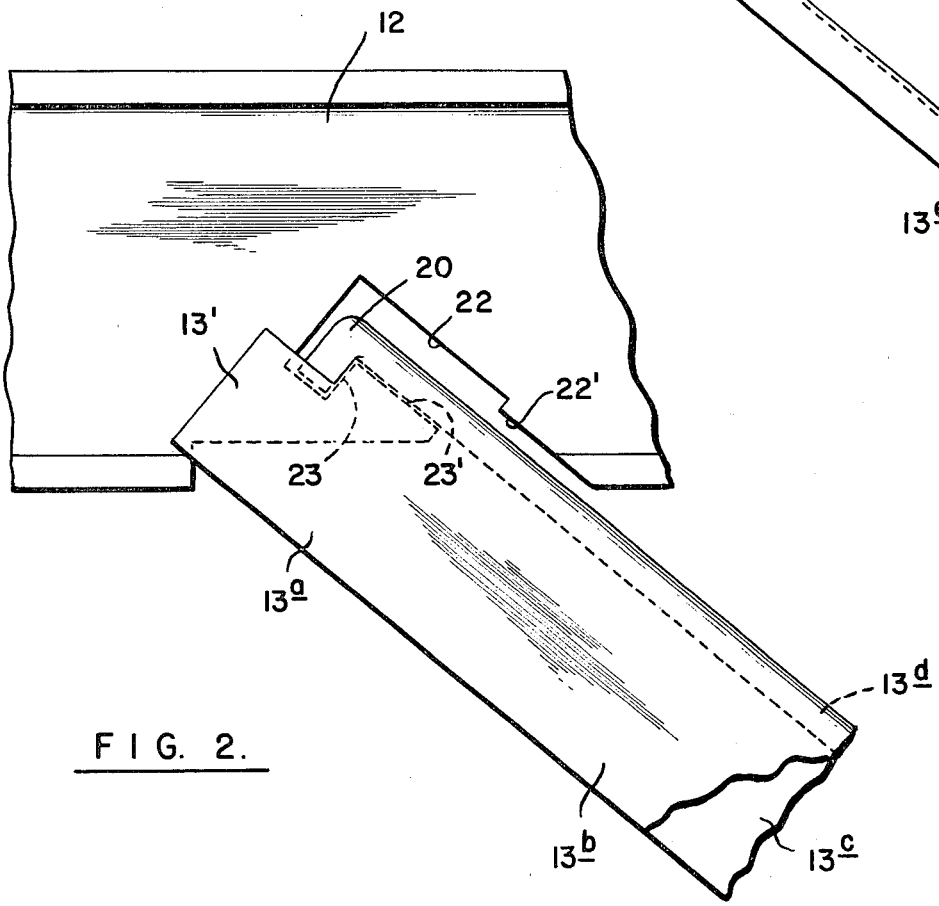
FIG. 2 is a greatly enlarged fragmentary view of a portion of the assembly illustrated in FIG. 1.

The brace 13 has an upper end 13*a* which interconnects with the arm 12 in a novel manner. To this end, cooperating latching means are provided on the upper end 13*a* of the brace 13 and the underside of the arm 12. In the illustrated embodiment best seen in FIG. 2, the brace 13 has a U-shaped transverse cross section with a pair of flanges or legs 13*b* and 13*c* connected together by an integral web 13*d*. The upper end of the web 13*d* is bent downwardly to provide a tip 20 extending transversely between the legs 13*b* and 13*c*. The brace legs 13*b* and 13*c* have end portions, such as the portion 13' on the leg 13*b*, which extend beyond the tip 20. The portions 13' are disposed on opposite sides of the arm web 12*a* and thus straddle the arm 12.

The brace 13 is connected to the arm 12 by means of simple longitudinal and rotary motion of the brace 13 relative to the arm 12. To this end, the arm web 12*a* is provided with an L-shaped notch 22 having its longest dimension inclined with respect to the arm and disposed substantially parallel with respect to the brace web 13*d*. The notch 22 is punched through the web 12*a* and provides a shoulder 23 which engages the tip 20 of the brace 13 in the manner illustrated to prevent lengthwise disengagement of the brace 13 from the arm 12. The entrance to the notch 22 has an offset 22' which defines with the shoulder surface 23' a dimension which is less than the overall dimension of the tip 20. This dimensioning prevents the brace 13 from moving laterally in the notch and thus disengaging the arm 12 after the tip 20 has been engaged with the shoulder 23 in the manner illustrated. The notch offset 22' also limits pivotal movement of the brace 13 in the counterclockwise direction during assembly. The disposition of the ends 13' of the brace legs **13*b* and 13*c* on opposite sides of the arm web 12*a* prevents the tip 20 from disengaging the arm 12 laterally when the brace is interlocked with the arm 12** in the manner illustrated.

The entire bracket assembly 10 is quickly and securely fastened together. To this end, the lower end **13*e* of the brace 13 is provided with a tang 25 which locks in place to the upright 11. In the illustrated embodiment the tang 25 is formed as a lengthwise extension of the brace web 13*d* and is bendable into the full line position indicated in FIG. 1 to lock the brace 13, arm 12 and upright 11 in the assembled configuration illustrated. The spacing between the legs 11*a* and 11*b* of the upright 11 is slightly greater than the overall width of the brace 13 so that the brace 13 cannot twist relative to the upright 11** when assembled.

Figure 3:
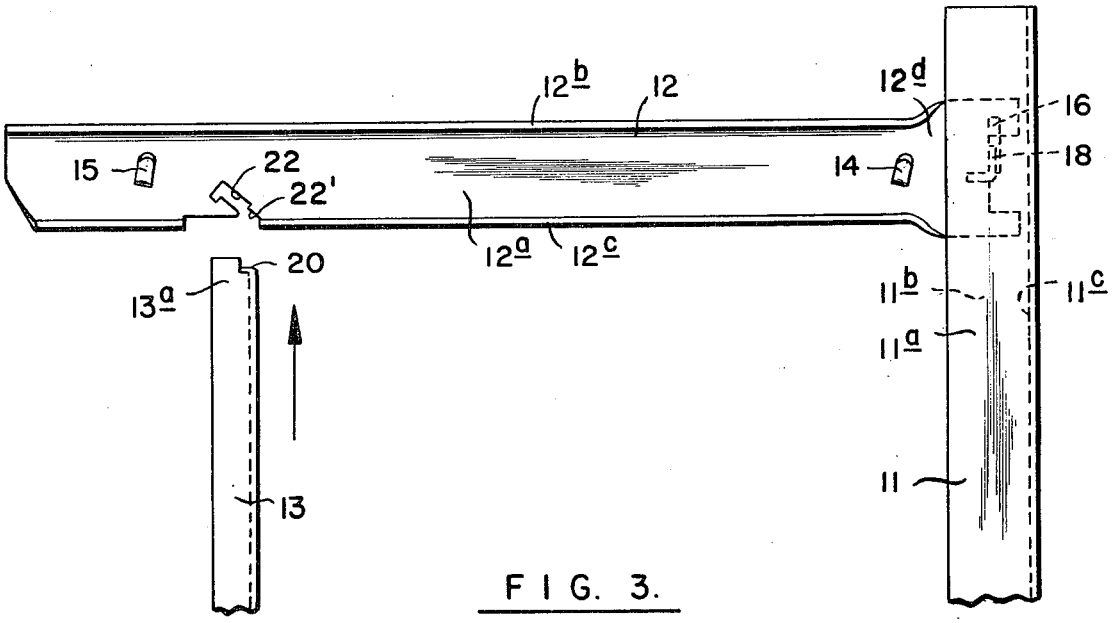
FIGS. 3, 4 and 5 are views illustrating the positioning of various parts during assembly.
Figure 4:
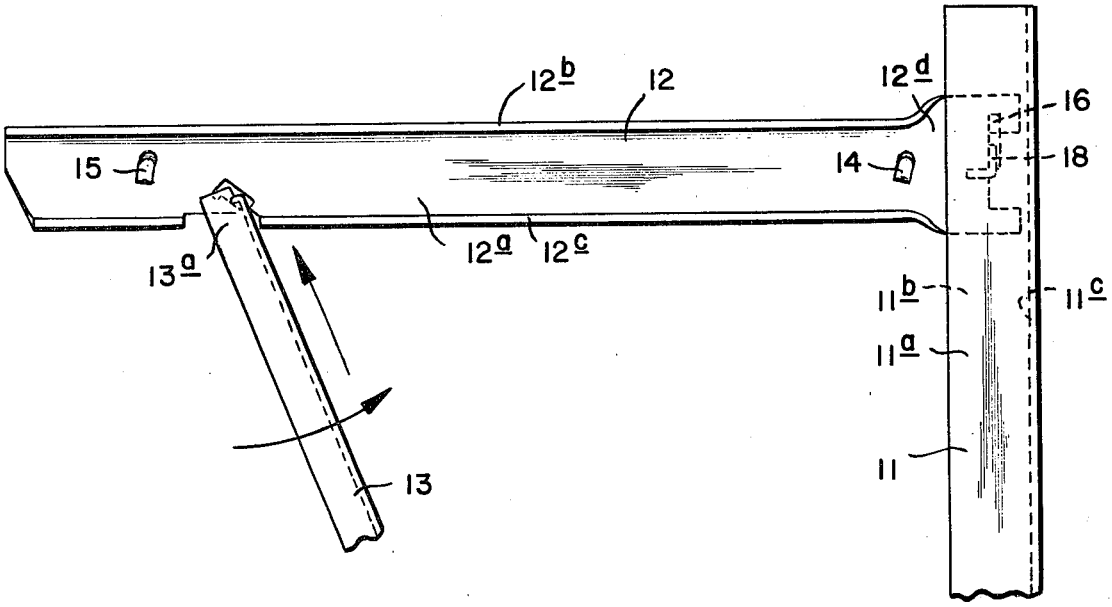
Figure 5:
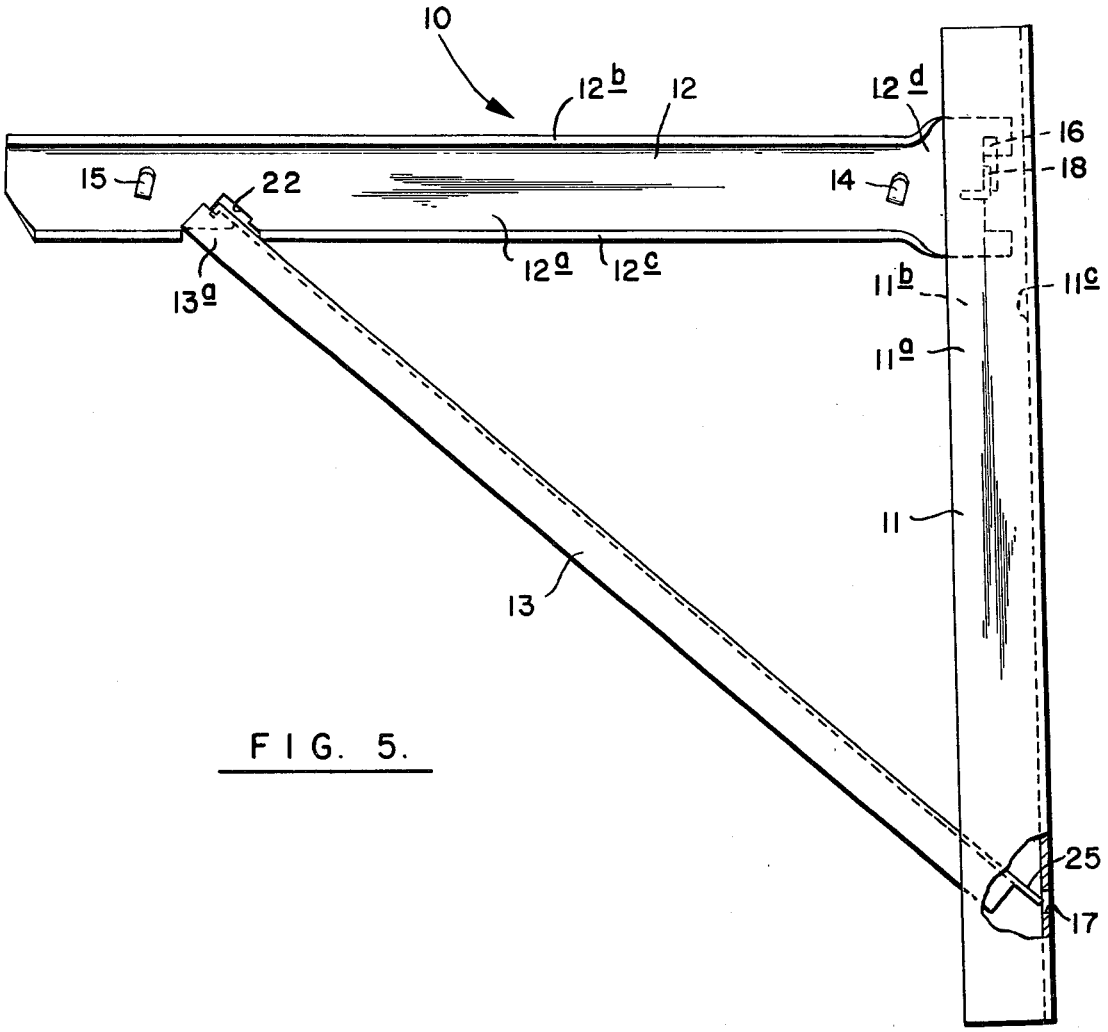

The brace 13 can be assembled quickly with the arm 12. This may best be seen with reference to FIGS. 3 and 4. In FIG. 3, the brace 13 is illustrated being pushed upwardly in the direction indicated by the arrow with its tip 20 aligned with the notch 22 in the arm 12. After the tip 20 has passed into the entrance of the notch 22, the brace 13 is pivoted in the clockwise direction indicated by the arrow in FIG. 4 while continuing to be moved lengthwise until the tip 20 is engaged with the shoulder 23 in the manner illustrated in FIG. 2. Thereafter, the free end of the arm 12 is pushed upwardly a slight distance to permit the tang 25 to be aligned with the hole 17 in the upright. The brace 13 is then pushed longitudinally downward and to the right to pass the tang 25 through the hole 17. After the tang 25 has passed through the hole 17, it assumes the position indicated in broken lines in FIG. 1. Thereafter, the tang 25 is struck by a tool, such as a hammer, and is bent downwardly against the outside of the upright 11.

After the tang 25 has been bent in the manner described, the entire assembly is positively interconnected in such a manner as to resist disconnection during handling of the bracket assembly 10. This is particularly important when the bracket assembly is used as a component of a poultry cage frame since it is customary for several frames to be assembled in an assembly area before being moved to the area where the cage banks are to be assembled onto the frames. The bracket assembly 10 of the present invention is able to withstand the rough handling often encountered in the process of moving frame assemblies from one location to the other. Of course, bracket assembly 10 also provides strong support for cages by virtue of the positive mechanical interlocks of the various components of the bracket assembly.

The present invention provides a number of advantages. First of all, it provides a sturdy support which is capable of being assembled rapidly using only a few simple commonly available hand tools. By eliminating the requirement for conventional fasteners, such as nuts and bolts, the bracket assembly of the present invention is not only quicker to install but is less expensive to manufacture. The bracket assembly is also capable of being disassembled quickly and reassembled should such be desirable in a particular situation.

In view of the foregoing, it should be apparent that the present invention provides an improved bracket assembly which can be used in a variety of ways, such as shelf supports, racks, etc. but which is particularly suited for use in supporting poultry cages.

While a preferred embodiment of the present invention has been described in detail, various modifications, alterations and changes may be made without departing from the spirit and scope of the present invention as defined in the appended claims.

I claim:

1. A three-piece bracket assembly capable of being erected without separate fasteners, comprising:

an upright having vertically spaced holes;

a laterally-extending arm having hook means at one end engaged in one of said holes in said upright and having a downwardly open notch spaced from said hook means;

a brace having one end received in said notch in said arm and extending at an angle between said arm and said upright;

cooperating latching means on one end of said brace and in said arm notch operable to interlock the brace and arm upon engagement of the brace with the arm and rotary motion of the brace into an acute angle relative to the arm, said cooperating latching means including a shoulder in said arm notch and a turned tip on said one end of said brace engaging said shoulder; and means on the other end of said brace providing a tang extending through the other one of said holes in said upright and engaged with the web of said upright adjacent said other one of said holes to lock the brace to the upright.

2. The bracket assembly according to claim 1 wherein said arm is substantially planar and said brace has an inverted U-shaped cross section with legs connected by a web, said web being bent downwardly across said legs at said one end to form said tip, and said web extending beyond the ends of the legs at the other end of the brace to form said tang.

3. The bracket assembly according to claim 1 wherein said upright has a U-shaped cross section with a web connecting its legs and said tang receiving hole is located in said upright web, the spacing between the legs of the upright being greater than the overall width of the brace so that said tang mounting end of said brace is received in said upright.

4. The bracket assembly according to claim 2 wherein said arm has a substantially planar web portion and said brace legs are disposed on opposite sides thereof when said tip is engaged in the arm notch.

5. The bracket assembly according to claim 1 wherein said notch and shoulder define an inclined L-shaped configuration having an entrance with a dimension less than the overall dimension of the brace tip to prevent longitudinal disengagement of the bracket from the arm.

6. The bracket assembly according to claim 1 wherein said hook means includes a flange integral with said arm and terminating in a tab bendable transversely with respect to the hook receiving hole in the upright for locking the arm to the upright.

7. A three-piece bracket assembly capable of being erected without separate fasteners, comprising:

an upright having a U-shaped cross section with legs connected by a web, an upper hole in one of said legs and a lower hole in said web;

a laterally-extending, substantially planar arm having an integral, laterally-turned hook at one end engaged in said upper hole in said upright and having a downwardly-open, L-shaped notch spaced from said hook;

a brace having a U-shaped cross section with legs connected by a web, said brace legs being received between the legs of the upright and straddling the lower portion of the arm adjacent said notch, one end of said brace being received in said notch in said arm and extending at an angle between said arm and said upright;

cooperating latch means on said one end of said brace and in said arm notch operable to interlock the brace and arm upon engagement of the brace with the arm and rotary motion of the brace into said angle relative to the arm, said latching means including a shoulder in said notch and a tip formed by a downturned end portion of the brace web; and a tang integral with said brace web extending through the lower one of said holes in said upright and engaged with the web of said upright adjacent said lower hole to lock the brace to the upright.

* * * * *